US011180973B2

(12) United States Patent
Telfer et al.

(10) Patent No.: US 11,180,973 B2
(45) Date of Patent: Nov. 23, 2021

(54) DOWNHOLE TEST TOOL AND METHOD OF USE

(71) Applicant: ARDYNE HOLDINGS LIMITED, Aberdeen (GB)

(72) Inventors: George Telfer, Aberdeen (GB); Alan Fairweather, Aberdeenshire (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 195 days.

(21) Appl. No.: 16/340,340

(22) PCT Filed: Oct. 9, 2017

(86) PCT No.: PCT/GB2017/053047
§ 371 (c)(1),
(2) Date: Apr. 8, 2019

(87) PCT Pub. No.: WO2018/069685
PCT Pub. Date: Apr. 19, 2018

(65) Prior Publication Data

US 2019/0226327 A1 Jul. 25, 2019

(30) Foreign Application Priority Data

Oct. 10, 2016 (GB) ..... 1617202
Feb. 23, 2017 (GB) ..... 1702897

(51) Int. Cl.
*E21B 31/16* (2006.01)
*E21B 29/00* (2006.01)
(Continued)

(52) U.S. Cl.
CPC ..... *E21B 34/12* (2013.01); *E21B 23/00* (2013.01); *E21B 23/01* (2013.01); *E21B 23/04* (2013.01);
(Continued)

(58) Field of Classification Search
CPC ..... E21B 29/002; E21B 29/005; E21B 31/16; E21B 33/1291
See application file for complete search history.

(56) References Cited

U.S. PATENT DOCUMENTS 3,826,307 A 7/1974 Brown et al.
4,678,035 A 7/1987 Goldschild
(Continued)

FOREIGN PATENT DOCUMENTS

CA 2834059 C 2/2016
EP 0504848 A1 9/1992
(Continued)

OTHER PUBLICATIONS

International Search Report dated Jan. 17, 2018 for PCT/GB2017/053047.
(Continued)

*Primary Examiner* — Cathleen R Hutchins
(74) *Attorney, Agent, or Firm* — Law Office of Jesse D. Lambert, LLC

(57) ABSTRACT

A circulation test tool and method of performing a circulation test in a wellbore during single-trip casing cutting and removal. An anchor mechanism (20), a mechanical-set retrievable packer (22) and a cutting mechanism (18) allow gripping and cutting of casing (14) with the mechanical set-retrievable packer (22) being set after the cut to carry out the circulation test. The well is kept under control during the cut by application of tension on the drill string to set the packer (22) at any time. The arrangement provides full annulus flow pass at the packer during cutting. Embodiments describe additional features of a drill to dress a cement plug or a settable bridge plug.

18 Claims, 9 Drawing Sheets

(51) Int. Cl.

| | |
|---|---|
| ***E21B 34/12*** | (2006.01) |
| ***E21B 23/04*** | (2006.01) |
| ***E21B 23/01*** | (2006.01) |
| ***E21B 33/12*** | (2006.01) |
| ***E21B 33/129*** | (2006.01) |
| ***E21B 33/128*** | (2006.01) |
| ***E21B 23/00*** | (2006.01) |

(52) U.S. Cl.
CPC ..... *E21B 23/0411* (2020.05); *E21B 29/005* (2013.01); *E21B 31/16* (2013.01); *E21B 33/1204* (2013.01); *E21B 33/1285* (2013.01); *E21B 33/1291* (2013.01); *E21B 2200/06* (2020.05)

(56) References Cited

U.S. PATENT DOCUMENTS

| | | | | |
|---|---|---|---|---|
| 5,101,895 | A | 4/1992 | Gilbert | |
| 5,141,053 | A | 8/1992 | Restarick et al. | |
| 6,896,064 | B2 | 5/2005 | Howlett et al. | |
| 7,546,876 | B2 | 6/2009 | McAfee | |
| 7,802,949 | B2 | 9/2010 | Fuhst et al. | |
| 9,464,496 | B2 * | 10/2016 | O'Rourke | E21B 29/005 |
| 2003/0201102 | A1 | 10/2003 | Mackenzie et al. | |
| 2007/0221372 | A1 * | 9/2007 | Telfer | E21B 33/128 166/120 |
| 2010/0186495 | A1 | 7/2010 | Bekkeheien | |
| 2011/0297379 | A1 * | 12/2011 | Laird | E21B 29/005 166/298 |
| 2012/0055681 | A1 | 3/2012 | Telfer | |
| 2012/0132438 | A1 | 5/2012 | Telfer | |
| 2012/0175108 | A1 | 7/2012 | Foubister et al. | |
| 2013/0048568 | A1 | 2/2013 | Crow et al. | |
| 2013/0168087 | A1 | 7/2013 | Linklater et al. | |
| 2016/0265295 | A1 | 9/2016 | Plante et al. | |

FOREIGN PATENT DOCUMENTS

| | | | |
|---|---|---|---|
| EP | 0554013 | A1 | 8/1993 |
| GB | 2280461 | A | 2/1995 |
| GB | 2461639 | A | 1/2010 |
| GB | 2535311 | A | 8/2016 |
| WO | 2005106189 | A1 | 11/2005 |

OTHER PUBLICATIONS

International Search Report dated Jan. 26, 2018 for PCT/GB2017/053044.

* cited by examiner

DOWNHOLE TEST TOOL AND METHOD OF USE

The present invention relates to a casing cutting and removal assembly and method of use, and in particular to a single-trip casing cutting and removal system in which a circulation test is performed to check for release of cut casing in applications in wellbore plugging and abandonment operations.

BACKGROUND TO THE INVENTION

During the construction of an oil or gas well, a hole is drilled to a pre-determined depth. The drilling string is then removed and a metal tubular or casing is run into the well and is secured in position using cement.

Once the casing is cemented and set in position in the wellbore, the wellbore may be drilled to a deeper depth by lowering a drill down the casing. Further strings of casing may be cemented into place in the wellbore. This process of drilling, running casing and cementing is repeated with successively smaller drilled holes and casing sizes until the well reaches its target depth. At this point, a final production casing is run into the well and is perforated to enable hydrocarbons to be produced.

Over time, which may be several decades, the production of hydrocarbons reduces until the production rate is no longer economically viable, at which point the well has reached the end of its productive life. The well is plugged and abandoned.

Abandonment of a well is carried out according to strict regulations in order to prevent fluids escaping from the well on a permanent basis. In meeting the regulations it has become good practise to create a cement plug over a predetermined length of the well and to remove the casing. Current techniques to achieve this may require multiple trips into the well, for example: to set a bridge plug to support cement; to create a cement plug in the casing; to cut the casing above the cement plug; and to pull the casing from the well. A further trip can then be made to cement across to the well bore wall. The cement or other suitable plugging material forms a permanent barrier to meet the legislative requirements.

Each trip into a well takes substantial time and consequently significant costs. Combined casing cutter and spear tools have been developed so that the cutting and pulling can be achieved on a single trip.

When cutting and pulling casing it is advantageous to test for circulation after the cut is completed. Such a test ensures that if there is any build-up of gas bubbles these can be circulated out of the well and also determines if the cut casing section can be pulled. The presence of drilling fluid sediments, cement, sand or other debris behind the casing can prevent the casing from being pulled. In these circumstances a higher cut must be made and again circulation is tested to determine if the casing can be pulled. These steps may occur multiple times until a casing section can be retrieved. Thus it is a requirement of the combined casing cutter and spear tools that they should provide for multiple cuts and circulation tests on a single trip.

A difficulty in the design of such combined cutter and spear tools is that when cutting, circulation needs to be maintained with the return path in the annulus between the work string and the casing so that cuttings can return to surface, however for the circulation test this return path needs to be closed to force the return path to be through the cut and behind the casing to surface.

U.S. Pat. No. 5,101,895 to Smith International, Inc. discloses a remedial bottom hole assembly for casing retrieval having a spear and an inflatable packer utilized in combination with a pipe cutter. With such an assembly, after the spear is set and the casing is cut, the packer can be inflated to determine if circulation can be established without the removal of the spear and pipe cutter.

There are a number of disadvantages with this assembly. Not actuating a seal until the cut is made in order to allow for circulation during the cut leaves the well open so that if a kick occurs during the casing cutting it becomes difficult to quickly get control of the well, as the inflatable packer cannot be set in these circumstances. Additionally, the inflatable packer is operated by a drop ball which requires a choke in the string to get the back pressure for actuation. Such a restriction induces high velocity flow at the choke which causes erosion and potential washout. Yet further, to switch the assembly between modes requires a one eighth turn of the string. Such manipulation cannot reliably be achieved when a cut is made far from surface.

US 2012/0285684 to Baker Hughes Inc. discloses a cut and pull spear configured to obtain multiple grips in a tubular to be cut under tension. The slips are set mechanically with the aid of drag blocks to hold a portion of the assembly while a mandrel is manipulated. An annular seal is set in conjunction with the slips to provide well control during the cut. An internal bypass around the seal can be in the open position to allow circulation during the cut. The bypass can be closed to control a well kick with mechanical manipulation as the seal remains set. If the tubular will not release after an initial cut, the spear can be triggered to release and be reset at another location. The mandrel is open to circulation while the slips and seal are set and the cut is being made. Cuttings are filtered before entering the bypass to keep the cuttings out of the blowout preventers.

Like the assembly of U.S. Pat. No. 5,101,895 this tool requires measured rotation of the string to switch the tool between modes to undertake a circulation test and to cut the casing, as these tools all operate using j-slot mechanisms. Such manipulation cannot reliably be achieved when a cut is made far from surface.

SUMMARY OF THE INVENTION

It is an object of the present invention to provide a robust and reliable casing cutting and removal assembly in a casing cutting and removal assembly suitable for deployment downhole which is capable of sealing the annulus between the drill string and the casing both for testing and in case of a kick, while also keeping the annulus clear during cutting.

It is a further object of at least one embodiment of the present invention to provide a method of performing a circulation test in a casing cutting and removal operation at multiple locations within a wellbore.

Further aims of the invention will become apparent from the following description.

According to a first aspect of the invention there is provided a downhole casing cutting and removal assembly located on a work string, having a bore therethrough, for performing a circulation test after the cut is complete comprising:

a spear for casing removal, the spear comprising an anchor mechanism configured to grip a section of a tubular in a wellbore for removal thereof;

a packer assembly being a mechanical tension-set retrievable packer configured to rapidly seal an annulus between the work string and the tubular; and a cutting mechanism configured to cut the tubular;

the anchor mechanism is located between the packer assembly and the cutting mechanism;

wherein in a first configuration the anchor mechanism grips the tubular as the cutting mechanism cuts the tubular and the packer assembly is unset so that cuttings can be circulated up the annulus; and in a second configuration the anchor mechanism grips the tubular, the cutting mechanism is stopped and the packer assembly is set with the annulus sealed so that a circulation test can be performed by pumping fluid from the annulus, through the cut and behind the cut tubular to surface.

In this way, the mechanical-set retrievable packer can be set rapidly in response to a kick and does not have the disadvantages of hydraulic-set pressure activated packers as per the prior art. Additionally, the mechanical-set retrievable packer does not require additional bypass ports which would obstruct the annulus during cutting.

The anchor mechanism may be configured to grip a section of a casing located in a wellbore. The anchor mechanism may be configured to grip a section of a casing at any axial position in the wellbore. In this way, the anchor mechanism can be used as a spear for casing removal. The anchor mechanism may be configured to be set at any axial position in the wellbore to allow the casing cutting and removal assembly to be anchored at any axial position in the wellbore for a circulation test to be performed, while then allowing the anchor mechanism to be moved to a upper location on the casing for casing removal.

Preferably the casing cutting and removal assembly is connected to a drill string. The cutting mechanism is located below the anchor mechanism and the mechanical-set retrievable packer is located above the cutting mechanism on the string. In this way, the packer can be set above the cut casing to perform the circulation test. The anchor mechanism is located between the cutting mechanism and the mechanical-set retrievable packer. In this way, the anchor mechanism can hold the casing in tension for the cut to be performed.

The anchor mechanism and the cutting mechanism may be axially spaced apart on the casing cutting and removal assembly to mitigate vibration effects or chattering on the casing cutting and removal assembly.

The anchor mechanism and the cutting mechanism may be axially spaced apart on the casing cutting and removal assembly by a distance of less than ten times the inside diameter of the casing.

The anchor mechanism and the cutting mechanism may be axially spaced apart on the casing cutting and removal assembly by a distance of less than five times the inside diameter of the casing.

The anchor mechanism and the cutting mechanism may be axially spaced apart on the casing cutting and removal assembly by a distance of less than two times the inside diameter of the wellbore casing.

By providing an anchor mechanism and cutting mechanism in such close proximity the structural integrity of the knives of the cutting mechanism may be preserved and their life span extended by avoiding damage due to vibration of the assembly. The close proximity of the anchor mechanism to the cutting mechanism provides a secure hold and prevents chattering when the knives engage and start to cut the casing. This may allow the assembly to perform a number of downhole cutting tasks in a single trip without having to return to surface for knife and/or tool repairs.

The anchor mechanism may be configured to be reversibly set at different axial positions in the wellbore.

Preferably the casing cutting and removal assembly has a tool body. The tool body may have a through bore. Preferably the anchor mechanism is located in the tool body. Preferably the anchor mechanism comprises a cone and at least one slip. The cone may be circumferentially disposed about a section of the casing cutting and removal assembly.

Preferably, the at least one slip is configured to engage an inner surface of the casing or downhole tubular. Preferably, the at least one slip is configured to engage an inner diameter of a section of the casing or downhole tubular. The at least one slip may bear against the cone to engage the casing or downhole tubular.

Preferably the cone has a slope. The slips may travel along the slope of the cone so that the slips extend from the tool body to engage and grip the casing or downhole tubular.

The anchor mechanism may comprise a sleeve configured to be slidably mounted within the tool body. The sleeve may be configured to move the at least one slip between a first position where the at least one slip does not engage the casing and a second position where the at least one slip engages the casing.

The anchor mechanism may be hydraulically or pneumatically actuated. The anchor mechanism may be actuated by pumping fluid into the tool. The anchor mechanism may be actuated by pumping fluid into a bore in the tool.

The anchor mechanism may be actuated to engage the downhole tubular by pumping fluid into a bore in the tool above a pre-set flow rate threshold. The sleeve of the anchor mechanism may be configured to move in response to fluid pressure acting on the sleeve or at least part of the sleeve.

The flow rate threshold may be set by changing the spring force acting on the sleeve.

The anchor mechanism and the mechanical-set retrievable packer may be axially spaced apart on the casing cutting and removal assembly.

The flow rate threshold may range from 50 to 500 gpm (0.0158 to 0.0315 $m^3$/sec). Preferably the flow rate threshold is 250 gpm (0.0158 $m^3$/sec).

By providing an anchor mechanism capable of being hydraulically or pneumatically actuated the anchor mechanism may be actuated at any axial position in the wellbore and may facilitate the assembly being anchored at any axial position in the wellbore.

The anchor mechanism may be resettable for positioning and gripping the casing or downhole tubular at multiple axial locations within the wellbore.

The anchor mechanism may be set to prevent accidental release of the anchor mechanism. The anchor mechanism may be set by providing an upward force or tension to the tool which is engaged on the tubular by the slips. The upward force or tension to the set the anchor mechanism may range from 2,000 lbs (8896 N) to 15,000 lbs (66723 N). Preferably the upward force or tension to the set the anchor mechanism is 10,000 lbs (44482 N).

The tension or pulling force may wedge or lock the slips between the surface of the cone of the assembly and the casing or downhole tubular.

This anchors the tool to the tubular. The anchor mechanism may be unset by applying a downward force to the tool.

By setting the anchor mechanism the fluid pressure may be reduced below the pre-set threshold flow rate or stopped without the anchor mechanism being deactivated. This may facilitate subsequent casing cutting and circulation testing.

The anchor mechanism may be resettable or reversibly set for gripping on the inside diameter of a first section of casing or downhole tubular wherein the anchor mechanism may be released and reset inside a second section of casing or downhole tubular to allow multiple circulation tests to be perform during the same trip in the well.

The mechanical-set retrievable packer is configured to seal the casing or downhole tubular. In this way, fluid flow is restricted to only the central throughbore and there is no pathway up the annulus between the circulation tool and the casing.

The mechanical-set retrievable packer may comprise a mandrel or sleeve which is configured to be axial movable relative to the tool body. Preferably mandrel or sleeve is axial movable relative to the tool body.

An upward force or tension applied to the drill string axially may move the mandrel or sleeve relative to the tool body. The axial movement of the mandrel or sleeve relative to the tool body in a first direction may actuate and set the mechanical-set retrievable packer. The axial movement of the mandrel or sleeve relative to the tool body in a second direction may de-actuate the mechanical-set retrievable packer.

Preferably the mechanical-set retrievable packer comprises at least one packer element. The packer element may be made from any material capable of radially expanding when it is axially compressed such as rubber.

The upward force or tension required to the set the mechanical-set retrievable packer may range from 20,000 lbs (88964 N) to 80,000 lbs (355858 N). Preferably the upward force or tension to the set the packer assembly is 30,000 lbs (133447 N).

The axial movement of the mandrel or sleeve relative to the tool body in a first direction radially expands the packer element. The radially expansion of the packer element may seal the wellbore. The axial movement of the mandrel or sleeve relative to the tool body in a second direction radially contracts the packer element.

Preferably the mechanical-set retrievable packer comprises at least one port configured to be in fluid communication with the annulus of the casing and/or downhole tubular. The at least one port may be configured to allow fluid communication between the through bore of the tool and the annulus of the casing and/or downhole tubular below the mechanical-set retrievable packer.

The axial movement of the mandrel or sleeve relative to the tool body in a first direction may open the at least one port. The axial movement of the mandrel or sleeve relative to the tool body in a second direction may close the at least one port.

The cutting mechanism may comprise at least one blade or knife.

Preferably the cutting mechanism comprises a plurality of knives. The plurality of knives may be circumferentially disposed about a section of the casing cutting and removal assembly.

The cutting mechanism may comprise a sleeve configured to be slidably mounted within the tool body. The sleeve may be configured to move the knives between a storage position where the knives are retracted and do not engage the casing and an operational position where the knives are extended and engage the casing.

The cutting mechanism may be hydraulically or pneumatically actuated. The cutting mechanism may be actuated by pumping fluid into the tool. The cutting mechanism may be actuated by pumping fluid into a bore in the tool. The sleeve of the cutting mechanism may be configured to move in response to fluid pressure acting on the sleeve or at least part of the sleeve.

A fluid displacement member may be disposed in a throughbore of the tool body and may be configured to introduce a pressure difference in the fluid upstream of the displacement member and the fluid downstream of the displacement member.

The fluid displacement member may provide a restriction and/or nozzle in a flow path in the tool body. The fluid displacement member may form a venturi.

The cutting mechanism may comprise a venturi. The cutting mechanism may comprise a venturi flow path. Preferably the cutting mechanism comprises a venturi flow path. The venturi flow path may be axially movable in the tool body. The downhole tool may comprise a venturi-shaped flow path. The venturi flow path may be configured to accelerate fluid flow through the tool body and/or cutting mechanism.

The fluid displacement member may be disposed in the venturi flow path and may be configured to introduce a pressure difference in the fluid upstream of the displacement member and the fluid downstream of the displacement member.

Fluid flow in the venturi flow path may provide a driving force to actuate the cutting mechanism.

The venturi flow path may be configured to move cuttings further downhole when fluid is passed through the venturi flow path.

The casing cutting and removal assembly may comprise a mechanism configured to provide a change in the fluid circulation pressure when the knives are deployed and/or a cutting operation complete. The fluid displacement member may be configured to provide a change in the fluid circulation pressure when the knives are deployed and/or a cutting operation complete. The pressure change may be an increase or a decrease in pressure.

The cutting mechanism may comprise a recirculating flow system arranged to direct flow and/or casing cuttings created by the cutting operation to a location away from the cutting site. The location away from the cutting site may be further down the annulus between the assembly and the casing being cut.

The recirculating flow path may comprise a first flow path extending between a throughbore in the tool body and the annulus of the wellbore. The recirculating flow path comprises a second flow path extending between the throughbore of the tool body and an opening on a lower end of the tool body, an opening on a lower hydraulically operable tool and/or an opening on a lower tool string component.

The first flow path and the second flow path may be in fluid communication in a channel in the tool body. Preferably the first flow path and the second flow path are configured such that fluid flowing through the first flow path draws fluid through the second flow path.

Preferably fluid flowing through first flow path actuates the cutting mechanism. The sleeve of the cutting mechanism may be configured to move in response to fluid flowing through first flow path and acting on the sleeve or at least part of the sleeve.

The differential pressure caused by the venturi effect entrains fluid to flow along the second pathway or flow path through the filter where it flows into the first pathway or flow path.

The downhole tool may comprise a bypass flow path around the cutting mechanism.

Preferably the bypass flow path is selectively openable and/or closable.

The tool may comprise a receptacle provided to collect the casing cuttings. The receptacle may facilitate the transportation of the cuttings back to surface. The receptacle may be connected to the casing cutting and removal assembly and the cuttings may be recovered when the casing cutting and removal assembly is recovered from the well.

The casing cutting and removal assembly may further comprise a drill, the drill being located at a distal end of the casing cutting and removal assembly. Mounting a drill bit on the end of the casing cutting and removal assembly allows initial dressing of a cement plug prior to casing cutting being achieved on the same trip into the wellbore.

Alternatively, the casing cutting and removal assembly may further comprise a bridge plug, the bridge plug being located at a distal end of the casing cutting and removal assembly. Mounting a bridge plug on the end of the casing cutting and removal assembly allows setting of a bridge plug in the casing prior to casing cutting being achieved on the same trip into the wellbore.

The drill or bridge plug may be hydraulically or pneumatically actuated. In this way the drill or bridge plug can be operated from surface without actuation of the anchor mechanism, mechanical-set retrievable packer or the cutting mechanism.

The casing cutting and removal assembly may include a bypass flow path around the anchor mechanism, wherein the bypass flow path is selectively operable. Preferably the bypass flow path is operable by movement of the sleeve of the anchor mechanism. The sleeve may be axially movable from the first position to the second position in response to a dropped ball.

This may allow the fluid pressure through the circulation tool to be increased above the threshold pressure of the anchor mechanism without actuating the anchor mechanism. This allows a drilling operation to be performed with a high fluid flow rate through the tool to actuate the drill or the bridge plug to be set using the high fluid flow rate.

According to a second aspect of the invention there is provided a method of performing a circulation test in a wellbore comprising the steps, in order:

(a) running a casing cutting and removal assembly according to the first aspect into the wellbore;
(b) actuating the anchor mechanism to grip a section of a tubular;
(c) actuating the cutting mechanism to cut the tubular while pumping fluid through a bore of the work string to circulate cuttings up an annulus between the work string and the tubular;
(d) deactivating the cutting mechanism;
(e) actuating the packer assembly to seal the annulus; and
(f) pumping fluid through the bore of the work string to circulate through the cut and behind the cut tubular to surface as a circulation test in the wellbore.

The method may comprise the step of determining circulation behind the cut tubular at surface. This provides a positive circulation test and the cut tubular section, preferably a casing section, can be removed.

Preferably the method includes the further steps of unsetting the packer and anchor mechanism, actuating the anchor mechanism to grip the cut tubular section at an upper location on the tubular, and removing the cut tubular section from the wellbore.

In the event that the circulation test is negative, there being no circulation behind the cut tubular, the method then comprises the further steps of unsetting the packer and anchor mechanism, locating the cutting mechanism at a higher position on the tubular and repeating the steps according to the second aspect. This can be repeated until a positive circulation test occurs and a section off cut tubular can be removed from the wellbore.

In this way, the casing cutting and removal assembly is run to a maximum depth in the casing, a cut made and a circulation test performed. Subsequent cuts and circulation tests are performed at increasingly higher locations in the wellbore until a cut casing section can be removed. By performing a circulation test at each cut location, an attempt to pull the cut casing section following every cut is not required which saves significant time in the recovery process.

The method may comprise hydraulically or pneumatically actuating the anchor mechanism. The method may comprise mechanically setting the actuated anchor mechanism. The method may comprise setting the anchor mechanism by providing an upward force or tension to the tool. The upward force or tension to set the anchor mechanism may range from 2,000 lbs (8896 N) to 15,000 lbs (66723 N). Preferably the upward force or tension to the set the anchor mechanism is 10,000 lbs (44482 N).

The method may comprise mechanically setting the packer assembly. The method may comprise setting the packer assembly by providing an upward force or tension to the tool. The upward force or tension to the set the packer assembly may range from 20,000 lbs (88964 N) to 80,000 lbs (355858 N). Preferably the upward force or tension to the set the packer assembly is 30,000 lbs (133447 N).

The method may comprise actuating the cutting mechanism by pumping a fluid into a bore in the casing cutting and removal assembly and rotating the cutting mechanism to cut the casing. The cutting mechanism may be rotated by rotating a drill string connected to the casing cutting and removal assembly.

The method may comprise monitoring the fluid pressure circulating through the casing cutting and removal assembly. The method may comprise deactivating the cutting mechanism based on the monitored fluid pressure level circulating through the casing cutting and removal assembly.

The method may comprise monitoring the force required to rotate the cutting mechanism.

The method may comprise pumping fluid through a venturi flow path in the casing cutting and removal assembly. The method may comprise pumping fluid through a venturi flow path and/or a recirculation flow path to move cuttings further downhole.

The differential pressure caused by the venturi effect entrains fluid to flow along the second pathway or flow path through the filter where it flows into the first pathway or flow path.

Preferably, the anchor mechanism is actuated to grip the casing when the cutting mechanism is actuated to cut the casing. In this way, the casing is held in tension when the cut is performed.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figures 1A, 1B, 1C, 1D, 1E, 1F:
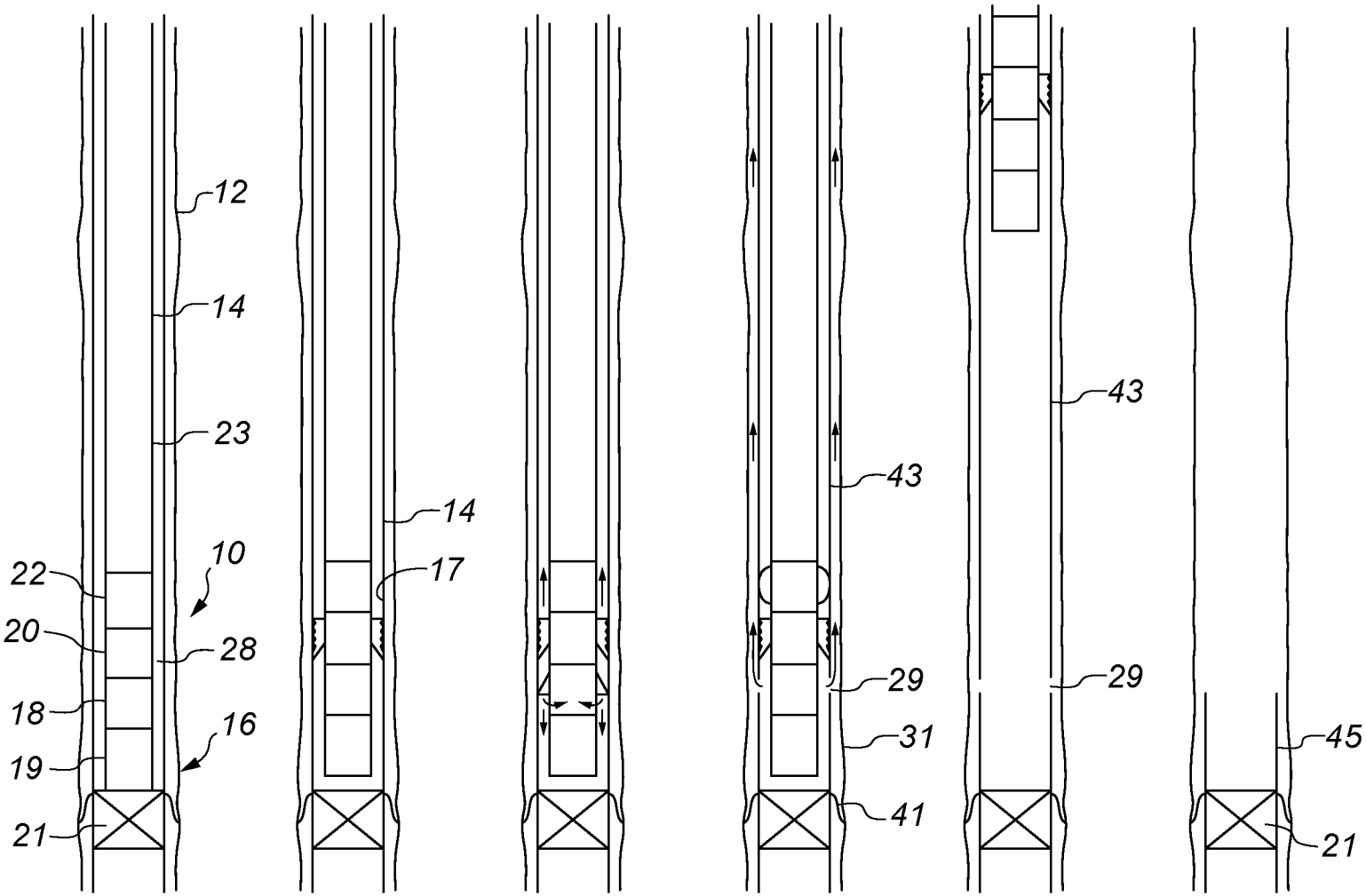
FIGS. 1A to 1F provide schematic illustrations of a method according to an embodiment of the present invention.

Referring initially to FIG. 1(*a*) of the drawings there is illustrated a casing cutting and removal assembly, generally indicated by reference numeral 10, run into a wellbore 12 which is lined with casing 14 or other tubular. Casing cutting and removal assembly 10 includes, from a first end 16, a cutting mechanism 18, an anchor mechanism 20 and a packer assembly 22 arranged on a drill string 23 or other tool string according to an embodiment of the present invention.

The cutting mechanism 18, anchor mechanism 20 and packer assembly 22 may be formed integrally on a single tool body or may be constructed separately and joined together by box and pin sections as is known in the art. Two parts may also be integrally formed and joined to the third part.

Figure 2A:
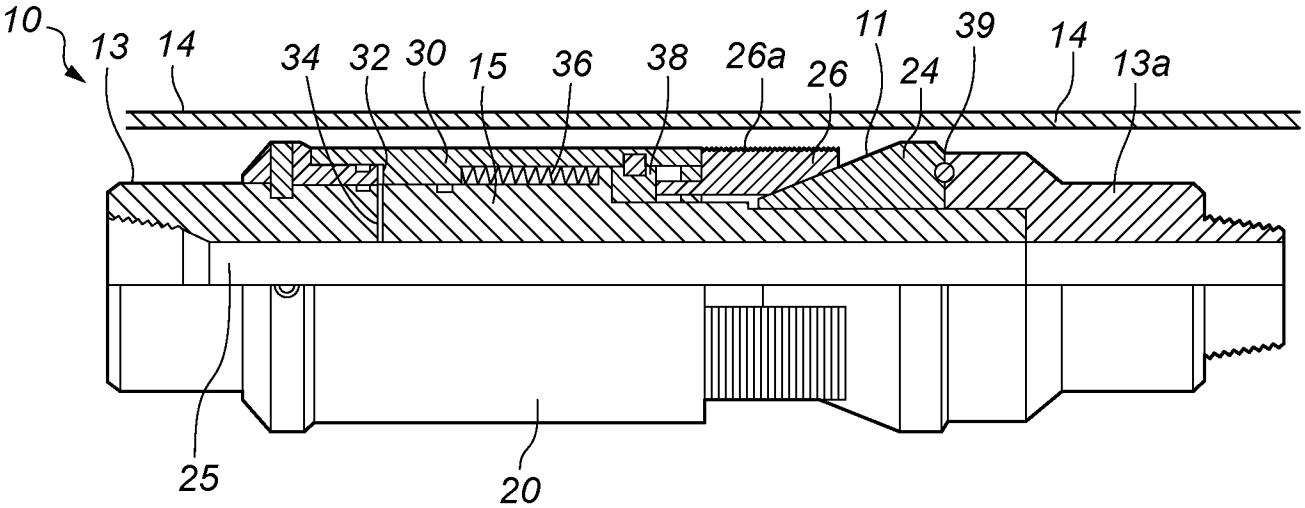
FIG. 2A is a sectional view of an anchor mechanism of a casing cutting and removal assembly in a run-in state according to an embodiment of the present invention.
Figure 2B:
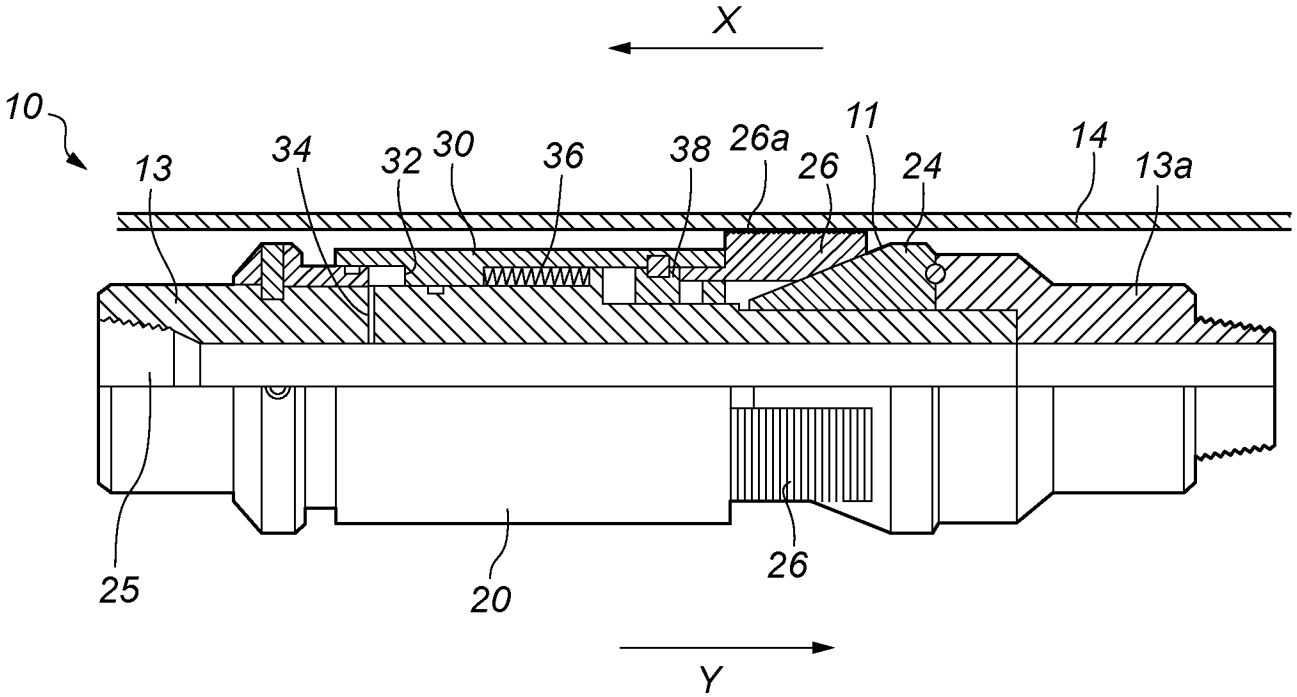
FIG. 2B is a sectional view of the anchor mechanism of FIG. 2A in an operational state.

FIGS. 2A and 2B are enlarged longitudinal sectional views of the anchor mechanism 20 of the casing cutting and removal assembly 10 in accordance with a first embodiment of the invention. The tool 10 has an elongate body 13 providing a mandrel 15 with a central bore 25 through which fluid is configured to be pumped.

The anchor mechanism 20 comprises a cone 24 circumferentially disposed about a section of the downhole tool 10. A plurality of slips 26 are configured to move along the surface of the cone 24. The slips 26 have a grooved or abrasive surface 26*a* on its outer surface to engage and grip the casing.

The slips 26 are configured to move between a first position shown in FIG. 2A on the cone 24 in which the slips 26 are positioned away from surface of the casing, and a second position in which the slips 26 engage the surface of the casing as shown in FIG. 2B.

The slips 26 are connected to a sleeve 30. The sleeve 30 is movably mounted on the body 13 and is biased in a first position by a spring 36 as shown in FIG. 2A. It will be appreciated that any spring, compressible member or resilient member may be used to bias the sleeve in a first position.

A shoulder 32 of the sleeve 30 is in fluid communication with the main tool bore 25 via a flow path 34. The sleeve 30 is configured to move from a first sleeve position shown in FIG. 2A to a second fluid position shown in FIG. 2B when fluid is pumped into bore 25 above a pre-set circulation threshold through flow path 34 to apply fluid pressure to shoulder 32 of the sleeve 30. Thus by the application of fluid pressure in the central through bore, the slips 26 will engage the inner surface 17 of the casing 14.

If tension is applied by overpulling the drill string 23 and the tool 10, the slips are further forced outwards to grip the inner surface 17 of the casing 14. This anchors the tool 10 to the casing 14 and sets the anchor mechanism preventing accidental release. Changing fluid pressure through the anchor mechanism will not deactivate the slips. The slips and anchor mechanism will release when the tension is removed and weight is set down on the string 23.

A bearing 39 on the tool body 12 connects the anchor mechanism 20 with the tool body 13. The anchor mechanism 20 is rotatably mounted on the body and is configured to secure the tool against the wellbore casing. An upward force applied to the tool body 13 may also apply pressure to the bearing 39 and may facilitate the rotation of lower tool body 13*a* which will be connected to the cutting mechanism 18 and thus allow rotation thereof.

Figure 3A:
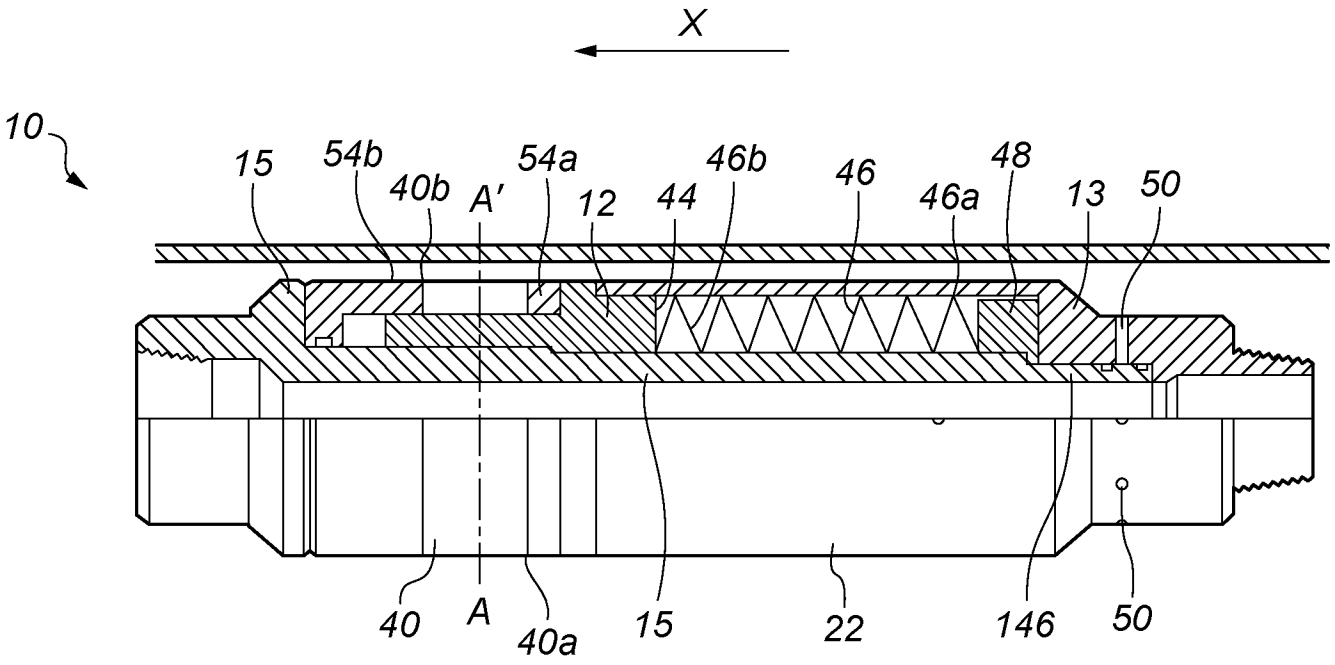
FIG. 3A is a sectional view of a packer assembly of a casing cutting and removal assembly in a run-in state according to an embodiment of the present invention.
Figure 3B:
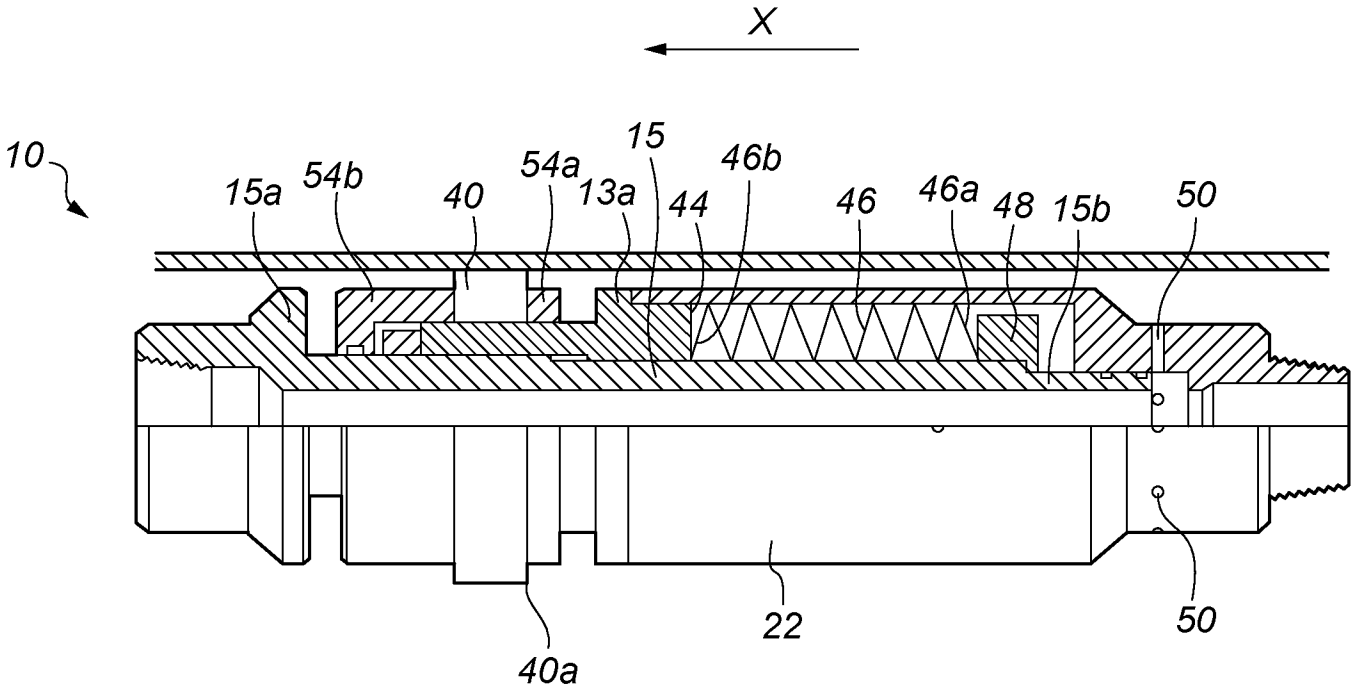
FIG. 3B is a sectional view of the packer assembly of FIG. 3A in an operational state.
Figure 3C:
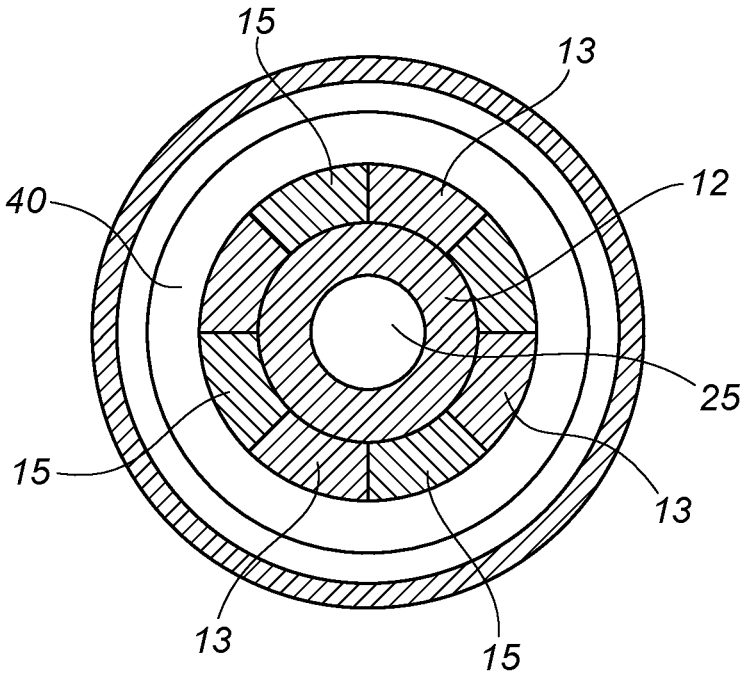
FIG. 3C is a sectional view of sections A to A' of the packer assembly of FIG. 3A.

FIGS. 3A and 3B are enlarged longitudinal sectional view of the packer assembly 22. FIG. 3C shows a cross-section view of line A-A' of FIG. 3A. Like parts to those in FIGS. 2A and 2B have been given the same reference numeral to aid clarity. The packer assembly 22 comprises a packer element 40. The packer element 40 is typically made from a material capable of radially expanding when it is axially compressed such as rubber or other elastomeric material.

The mandrel 15 is movable in relation to the body 13. A spring compression ring 48 is mounted on the second end 15*b* of the mandrel. The spring compression ring 48 is configured to engage a first end 46*a* of spring 46. The second end 46*b* of the spring 46 is connected and/or engages shoulder 44 on the tool body 12. The mandrel is movably mounted on the body 12 of the tool 10 and is biased to a first position shown in FIG. 3A by spring 46.

The mandrel is configured to move from a first mandrel position shown in FIG. 3A to a second mandrel position shown in FIG. 3B when an upward tension or force is applied to the tool 10 via the drill string 23.

In the first mandrel position ports 50 are blocked by the second end 14*b* of the mandrel. In the second sleeve position ports 50 are open and in fluid communication with the annulus 28 below the packer element 40.

In the first mandrel position the spring force of spring 46 maintains the position of the mandrel 15 relative to the body 12. The packer element 40 is not compressed and ports 50 are covered by the mandrel.

In the second mandrel position the mandrel 15 moves relative to the body, the upward force acting on the tool 10 and mandrel moves the spring compression ring 48 in a direction X which compresses the spring 46. A lower gauge ring 52 mounted on the mandrel 14 engages a first edge 40*a* of the packer element 40. An upper gauge ring 54 mounted on the tool body engages a second edge 40*b* of the packer element.

An upward force acting on the tool 10 moves the lower gauge ring 52 toward the upper gauge ring 54 compressing the packer element 40. Compression of the packer element 40 causes it to radially expand to contact the casing and seal the annulus of the wellbore.

The above-example describes a tension-set packer assembly. The upward force or tension applied to the tool has a pre-set lower threshold such that the spring force of spring 46 is overcome when upward force or tension is applied above the lower threshold. The lower threshold may be the minimum force or tension required to overcome the spring force of spring 46. The lower threshold may be adjustable to change the minimum force or tension required to overcome the spring force of spring 46.

Figure 4A:
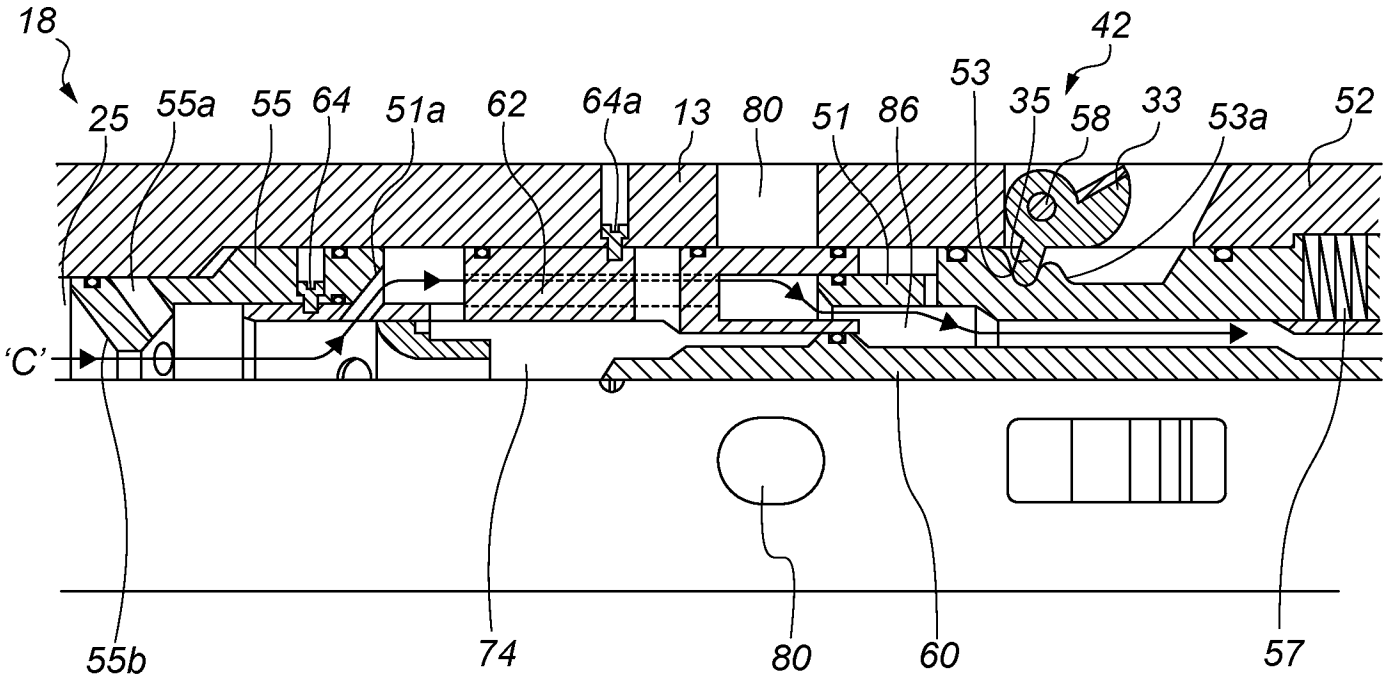
FIG. 4A is a sectional view of a cutting mechanism of a casing cutting and removal assembly in a run-in state according to an embodiment of the present invention.
Figure 4B:
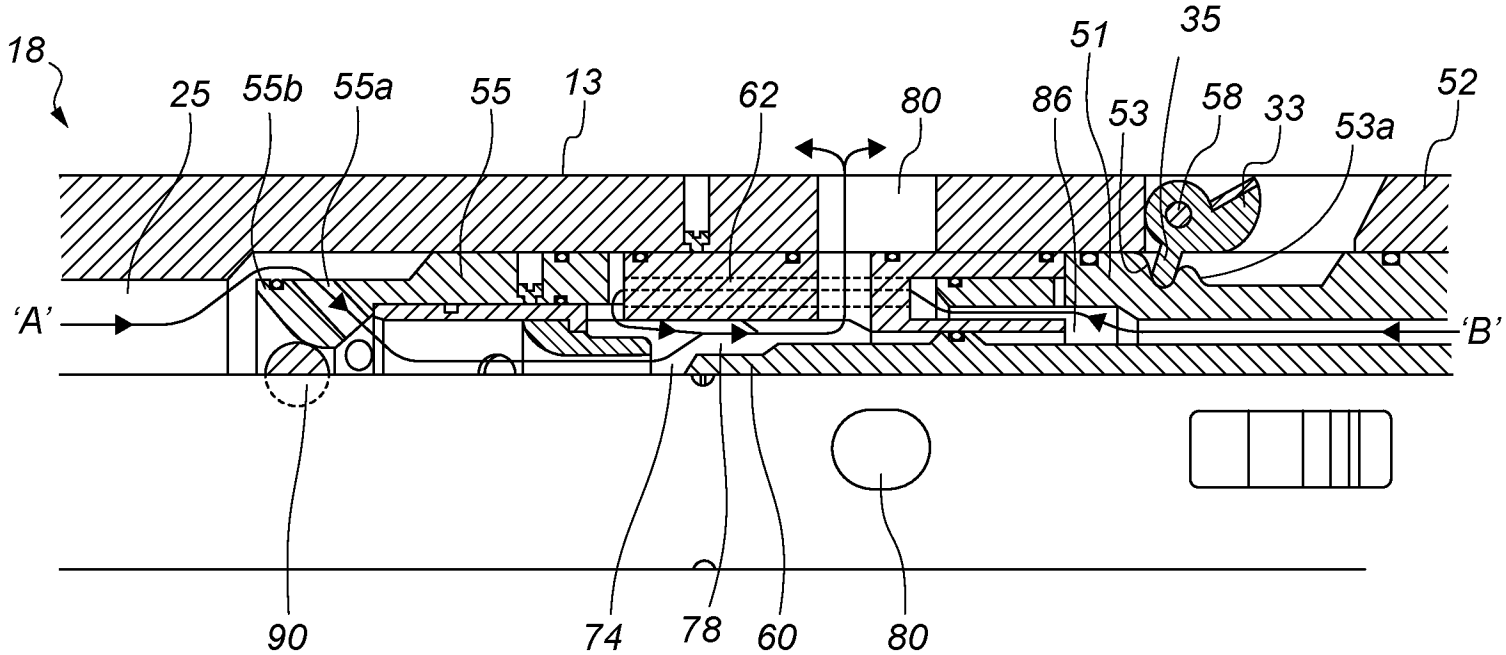
FIG. 4B is a sectional view of the cutting mechanism of FIG. 4A in an operational state.
Figure 4C:
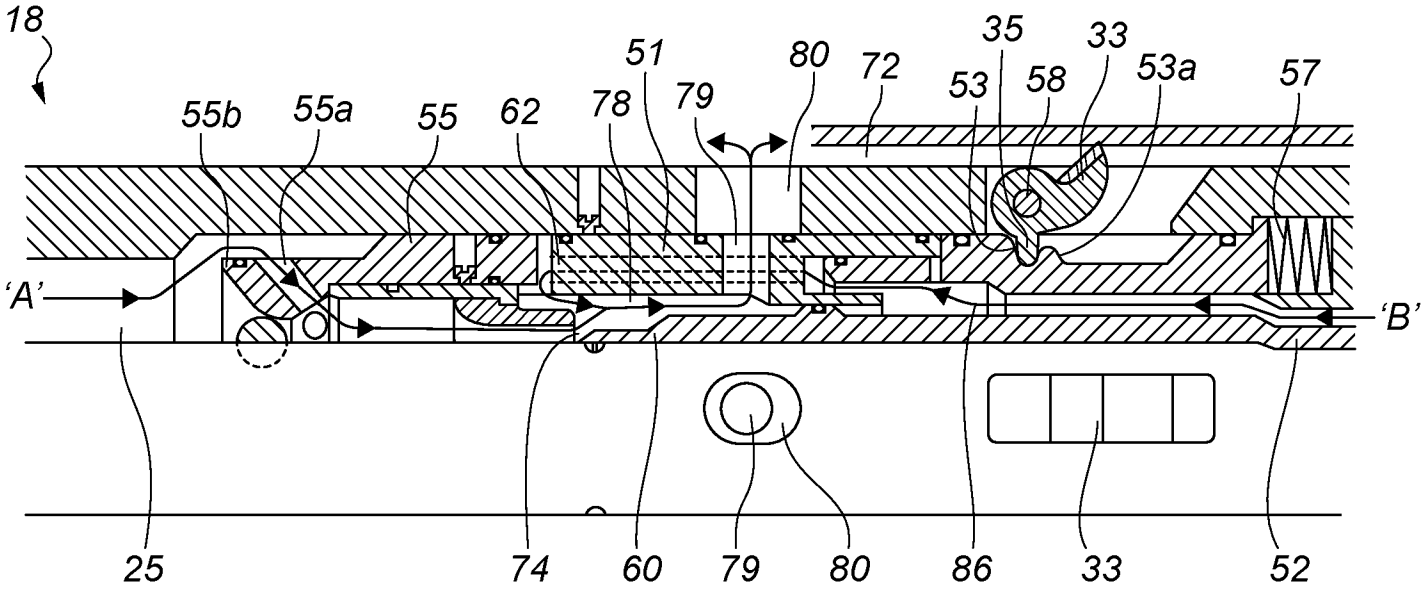
FIG. 4C is a sectional view of the cutting mechanism of FIG. 4A in an cutting state.

FIGS. 4A, 4B and 4C are longitudinal sectional views of a cutting mechanism 18 in a casing cutting and removal assembly 10 when connected to a tool string in accordance with an embodiment of the invention in different phases of operation. Like parts to those of the earlier Figures have been given the same reference numeral to aid clarity.

FIG. 4A is a longitudinal section through the cutting mechanism 18. The cutting mechanism 18 has an elongate body 13 with a first end 52 and a second end (not shown). The first end 52 is designed for insertion into the wellbore first and is configured to be coupled to a lower tool or string. The lower tool may comprise at least one hydraulically operable tool connected to the drill string. The tool body 13 comprises a cutting system 42 configured to cut a casing.

FIG. 4A shows the tool in a circulation mode where fluid flows through a circulation flow path through the tool.

An annular sleeve 51 is slidably mounted in the bore 25. The sleeve 51 is configured to move axially between a first position shown in FIG. 4A and second position shown in FIG. 4C. Intermediate positions may be selected as shown in FIG. 4B. The sleeve 51 comprises a shoulder 53 which is configured to engage with a pivot arm 35 connected to the cutting knife 33. The shoulder 53 of the sleeve 51 is configured to pivotally move the knives 33 between a knife storage position shown in FIG. 4A and a knife deployed position shown in FIG. 4C.

An annular port closing sleeve 55 is slidably mounted in the bore 25. The port closing sleeve 55 is configured to move axially between a first position shown in FIG. 4A and second position shown in FIG. 4B. The annular port closing sleeve 55 is configured to engage sleeve annular sleeve 51 such that in a first position port 51*a* on the sleeve 51 is open and in a second position port 51*a* is closed.

The annular sleeve 51 comprises a bypass channel 62. The bypass channel 62 is in fluid communication with bore 25 through ports 51*a*. The annular sleeve 51 is movably mounted in the tool and is biased in a first position by a spring 57.

The annular port closing sleeve 55 is held in a first position relative to the body 13 by shear screws 64. The annular sleeve 51 is held in a first position relative to the body 13 by shear screws 64*a*. Fluid flowing through the upper drill string flows through the circulation flow path. Fluid flows from bore 25 through ports 51*a* into bypass channel 62. The flow continues through channel 86 into the lower drill string bore (not shown).

FIG. 4B shows the cutting mechanism 18 when switched to a cutting operation mode. In this mode the annular port closing sleeve 55 is moved to a second position where it blocks ports 51*a* on the sleeve 51 closing the circulation flow path. Ports 55*a* on the port closing sleeve 55 are opened allowing fluid flow through the first flow path denoted as "A" in FIG. 4B. However, in FIG. 4B there is not sufficient fluid flow through the first flow path to operate the cutting system 42.

A fluid displacement member 60 is disposed in the bore 25 and is configured to introduce a pressure difference in the fluid upstream of the displacement member and the fluid downstream of the displacement member 60.

When the tool is switched to a cutting operation mode the bore 25 is in fluid communication with the annular space 28 through a first flow path denoted by arrow "A" in FIG. 4B. The first flow path comprises ports 55*a*, channel 78 located between the sleeve 51 and the displacement member 60, a port 79 in the sleeve 51, an outlet 80 in the body 13 and into the annular space 28. The fluid displacement member 60 acts to direct the fluid into channel 78.

FIG. 4C shows the tool during a cutting operation. Fluid flows through the first flow path to actuate the cutting system 42.

The sleeve 51 is configured to be moved from a knife retracted position shown in FIG. 4B to a knife deployed position shown in FIG. 4C when fluid pressure is applied to shoulder 55*b* of the sleeve 55. When fluid pressure applied to shoulder 55*b* is sufficient to overcome the spring force of spring 57 the sleeve 51 moves toward the first end 52 of the cutting mechanism 18. The fluid displacement member 60 remains stationary.

In FIG. 4C the annular sleeve 51 is located in a knife deployed position wherein the flow area of the nozzle 74 is reduced by the movement of the sleeve 51 toward end 52. The reduced flow area increases the fluid pressure through the nozzle 74. Measuring and/or monitoring the fluid pressure through the nozzle 74 may provide an indication of the movement of the annular sleeve 51 and the movement of the knives to a cutting operational position as shown in FIG. 4C.

FIG. 4C shows that the cutting mechanism 18 comprises a second flow path denoted by arrow "B". The fluid inlet of the second flow path is a port (not shown) located on the lower drill string or a tool located below the tool 10.

The second flow path passes through a channel 86 in the annular sleeve 51 and into a channel 78 located between the sleeve 51 and the displacement member 60. In channel 78 the fluid from the second flow path joins the fluid passing through the first flow path. The fluid exits the tool body into the annular space 28 via port 79 in the sleeve 51 and through an outlet 80 in the body 13 and into the annular space 28.

Optionally, the second flow path may comprise a screen to prevent casing cutting and solids from entering the tool 10 via the second flow path.

The outlet 80 is dimensioned such that it is larger than the port 79 on the sleeve 51. This is to ensure that fluid flow through port 79 and outlet 80 is maintained as the sleeve moves between the first and second positions shown in FIGS. 4A and 4C. This provides an axially movable venturi flow path which moves as the axial position of the sleeve 51 moves. Such a venturi flow path diverts the cuttings down the annulus 28. This is preferential to carrying the cuttings to surface were they must be disposed of and can damage the packer element.

In use, the casing cutting and removal assembly 10 is assembled on a drill string 23, in the order of the packer assembly 22, the anchoring mechanism 20 and the cutting mechanism 18. There may also be a drill 19 mounted on the end 16 for dressing a cement plug 21 already located in the casing 14. Alternatively, a bridge plug (not shown) could replace the drill 19 and be set in the casing 14 in place of the cement plug 21.

Referring to FIG. 1A of the drawings, the casing cutting and removal assembly 10 is run-in the wellbore 12 and casing 14 until it reaches the cement plug 21. At this point a wellbore integrity test can be performed using the anchor mechanism 20 and the packer assembly 22, if desired. With the cutting mechanism 18, anchor mechanism 20 and packer assembly 22 all held in inactive positions, fluid can be pumped at a fluid pressure below a pre-set threshold through the bore 25 of the drill string 23 to hydraulically activate the drill 19. This does not actuate the cutting mechanism 18, anchor mechanism 20 or the packer assembly 22. The drill 19 is used to dress the cement plug 21.

The casing cutting and removal assembly is then pulled up to locate the knives 33 of the cutting mechanism 18 at a desired location to cut the casing 14. At this position, the anchor mechanism 20 is hydraulically actuated to grip the casing surface 17 to secure the axial position of the tool 10 in the wellbore. The fluid circulation rate through bore 25 is increased above the pre-set threshold rate. Referring to FIGS. 2A and 2B, fluid flows through flow path 34 and acts on shoulder 32 of the sleeve 30 in the anchor mechanism 20. The pre-set threshold is set by the spring force of spring 36. In this example, the first pre-set threshold is 250 gallons per minute (gpm) (0.0158 $m^3$/sec).

The fluid pressure of the fluid above the pre-set threshold overcomes the spring force of spring 36. The sleeve 30 moves along the longitudinal axis of the tool body 13 to the second position shown in FIG. 2A. A slip retaining ring 38 is secured to the sleeve 30 and is connected to the slips 26. The sleeve 30 and slip retaining ring 38 push the slips 26 along the slope 11 of cone 24.

The slips 26 extend outward and engage the surface of casing 14. The slips provide friction to maintain the position of the tool 10 within the casing.

The tool 10 is then anchored to the casing by reversibly setting the anchor mechanism 20. To set the anchor mechanism an upward tension or pulling force is applied to the drill string as shown by arrow X in FIG. 2B. In this example 10,000 lbs (44482 N) upward tension or pulling force is applied to set the anchor, although it will be appreciated that the anchor mechanism may be configured to set at different tension or pulling forces.

The tension or pulling force causes the slips to be wedged or locked between the surface of the cone 24 of the tool and the casing 14 of the wellbore. At this point the tool will remain at this location even if the fluid pressure in the bore 25 is stopped or reduced below the pre-set threshold.

If the anchor mechanism 20 is not set the anchor mechanism reverts to its first position shown in FIG. 2A when the fluid pump is stopped or fluid pressure is reduced below the pre-set threshold. The spring force of spring 36 moves the sleeve 30 to the first position shown in FIG. 2A. The slips 26 which are in contact with the slip retaining ring 38 are pulled along the slope 11 of cone 24 and moved away from the surface of casing 15.

Once the anchor mechanism 20 has engaged the casing 14 and is set, as illustrated in FIG. 1B, the cutting mechanism 18 can be actuated. Note that the casing 14 is held in tension when the cutting mechanism 18 is operated.

Operation of the cutting apparatus will now be described with reference to FIGS. 4A, 4B and 4C. In FIG. 4A, the cutting mechanism 18 is shown in a tool run in phase, with the cutting system 42 in a retracted storage position. This is as for FIGS. 1A and 1B. In this retracted position fluid pumped into bore 25 enters the circulation flow path as denoted by arrow "C" in FIG. 4A. Fluid flow through this circulation flow path does not actuate the knives and they remain in a retracted position as shown in FIG. 4A while allowing the transfer of torque and fluid to the drill bit 19.

In order to switch the cutting mechanism 18 to a cutting operation position as shown in FIG. 4B, a ball 90 is dropped in the bore of the tool string and is carried by fluid flow through bore 25 until it is retained by the shoulder 55*b* of the port closing sleeve. Fluid pressure acts on the ball sheering screws 64, 64*a* and moves the port closing sleeve 55 and sleeve 51 to a second position where ports 51*a* on the sleeve 51 are closed and ports 55*a* on the port closing sleeve 255 are opened. This closes the circulation path "C" and opens a first flow path denoted by arrow "A" in FIG. 4B.

The first flow path passes from the bore 25 through ports 55*b*, through a channel 78 located between the sleeve 51 and the displacement member 60, a port 79 in the sleeve 51 and through an outlet 80 in the body 13 and into the annular space 28.

FIG. 4C show the actuation of the cutting mechanism 18 when in a cutting operation position. Fluid is pumped into the tool string and flows through the first flow path to actuate the cutting system 42.

During the cutting operation the anchor mechanism 20 remains substantially stationary relative to the cutting mechanism 18, with rotation of the cutting mechanism being made possible via the bearing 39.

The fluid pumped into bore 25 acts against shoulder 55*a* of the port closing sleeve 55. When the fluid pressure is sufficient to overcome the spring force of spring 57 the port closing sleeve 55 and sleeve 51 are moved towards end 52 of the downhole tool. Axial movement of the sleeve 51 towards first end 52 of the tool causes shoulder 53 of the sleeve 51 to act against the pivot arm 35 to rotate the knife 33 from a retracted storage position to an extended operational position.

FIG. 4C shows that the cutting mechanism 18 comprises a second flow path denoted by arrow "B". The fluid inlet of the second flow path is port (not shown) located on the lower tool string or a tool located on the lower tool string.

The second flow path passes from a bore of a lower tool string (not shown) to channel 86 in the annular sleeve 51 through channel 62 and into a channel 78 located between the sleeve 51 and the displacement member 60. In channel 78 the fluid from the second flow path joins the fluid passing through the first flow path. The fluid exits the tool body into the annular space 28 via port 79 in the sleeve 51 and through an outlet 80 in the body 13 and into the annular space 28.

The first flow path and the second flow path are in fluid communication in channel 78 located between the sleeve 51 and the displacement member 60. Fluid flowing through channel 78 along the first flow path induces a venturi effect in the second flow path denoted by arrow "B" in FIG. 4C and draws fluid up through the lower drill string and through the second flow path.

Fluid flow through the first flow path directs fluid flow into the annular space 28. As the flow through the first flow path creates a venturi effect in the second flow path and induces fluid flow in the second flow path from the bore of a lower drill string (not shown) it creates a localised recirculation of fluid.

The bore of lower drill string and/or drill 19 connected to the lower drill string may have ports in fluid communication with the annular space 28. The recirculation of fluid directs the flow of fluid from the outlet 80 which entrains cuttings during the cutting operation and moves the fluid and cuttings further downhole toward the ports on the lower drill string and/or a tool. This action allows the cuttings to be moved further downhole away from the cutting site.

The axially movable venturi flow path provides a driving force to actuate the cutting system 42 and induces localised recirculation of fluid around the tool to ensure that the casing cuttings are removed from the cutting site.

This is as illustrated in FIG. 1C which arrows showing the direction of fluid flow. It is noted that upward flow travels in the annulus 28 passed the packer assembly 22 without any obstructions in the annulus 28 at the location of the packer assembly 22.

If a kick occurs in the wellbore 12 for any reason, the packer assembly can be rapidly set to seal the wellbore by simply applying greater tension to the drill string 23 to set the packer. This is described hereinafter with reference to setting the packer for a circulation test.

When the cutting mechanism 18 has finished cutting the casing, the cutting mechanism is deactivated. The rotation the tool string is stopped to stop the rotation of the cutting mechanism. Optionally, the fluid pump is deactivated. The absence of fluid pressure on the shoulder 55*a* of the sleeve 55 causes the spring force of spring 57 to act on the sleeve 51 to move the sleeve 51 to a position shown in FIG. 4B. The movement of the sleeve moves the shoulder 53*a* to engage the pivot arm 35 to rotate the knives to a retracted position.

To perform a circulation test the packer assembly 22 is first set to seal the casing 14. To set the packer an upward tension or pulling force is applied to the drill string as shown by arrow X in FIG. 3A. In this example 60,000 lbs of upward tension or pulling force is applied to the drill string.

The axial position of the tool body 13 in the wellbore is maintained by the anchor mechanism 20 gripping the casing. The mandrel 15 connected to the upper drill string is moved to a second position shown in FIG. 3B by the upward tension or pulling force. The lower gauge ring 54*a* mounted on the mandrel 15 engages a first edge 40*a* of the packer element 40 resulting in axial compression of the packer element between lower gauge ring 54*a* mounted on the mandrel 15 and upper gauge ring 54*b* mounted on the tool body. As the packer element is axially compressed it radially expands to engage the casing and seals the casing annulus 28. The upward force is maintained to seal of the wellbore.

Ports 50 in the mandrel are opened allowing fluid communication between the bore 25 and the annulus 28 below the packer assembly. This is as illustrated in FIG. 1D.

The annulus 28 is now sealed off and pressurised fluid pumped through the drill string 23 will enter the annulus 28 and travel through the cut 29 in the casing 14. While fluid can travel down between the casing 14 and the formation 31 it will be stopped at cement 41. In this way, the fluid will be forced upwards between the casing 14 and the formation 31 towards the surface. A recording of pressure in the annulus behind the casing at surface indicates a positive circulation test and that the annulus behind the casing is free of debris which may cause the casing 14 to stick when removed. The casing 14 can now be removed.

On completion of the circulation test, the upward force or tension applied to the drill string is reduced to allow the spring 46 of the packer assembly 22 to move the mandrel 15 to a first position shown in FIG. 3A. The packer element 40 returns to its original uncompressed state and moves away from the well casing 14.

To unset and release the anchor mechanism a downward force is applied in the direction shown as "Y" in FIG. 2B which momentarily moves the cone 24 away from the slips 26 which is sufficient to allow the spring force of the spring 36 to pull the slips 26 along the slope 11 of the cone and away from the casing 14 to the first position shown in FIG. 2A.

The tool 10 is now relocated to a new axial position in the casing 14 with the anchor mechanism 20 located at an upper end of the cut section of casing 43. In this position the anchor mechanism 20 is activated to grip the casing section 43 as described above and as illustrated in FIG. 1E.

By pulling the drill string 23 and the casing cutting and removal assembly 10 from the wellbore 12, the cut section of casing 43 is removed from the wellbore 12. The wellbore 12 now contains the casing stub 45 and cement plug 21 as shown in FIG. 1F.

In the event that the circulation test is negative, that is a pressure increase is not seen at surface, then it is assumed that cement or other debris is located in the annulus between the cut casing 43 and the formation 31 which will prevent movement and subsequent recovery of the cut casing section 43. The drill string 23 and casing cutting and removal assembly 10 and then pulled up the casing to locate the knives 33 of the cutting mechanism 18 at a location higher in the well on the cut casing section 43.

At this new position the method is undertaken again starting from FIG. 1B with the anchor mechanism 20 being reset. As the anchor mechanism 20, cutting mechanism 18 and packer assembly 22 are all retrievable, they can be operated multiple times in a single trip in the wellbore 12 until a section of casing is removed.

The principal advantage of the present invention is that it provides a robust and reliable casing cutting and removal assembly in a casing cutting and removal assembly suitable for deployment downhole which is capable of sealing the annulus between the drill string and the casing both for testing and in case of a kick, while also keeping the annulus clear during cutting.

A further advantage of at least one embodiment of the present invention is that it provides a method of performing a circulation test in a casing cutting and removal operation at multiple locations within a wellbore.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended.

We claim:

1. A downhole casing cutting and removal assembly located on a work string, having a bore therethrough, for performing a circulation test after the cut is complete, the assembly comprising:

a spear for casing removal, the spear comprising an anchor mechanism configured to grip a section of a tubular in a wellbore for removal thereof;

a packer assembly being a mechanical tension-set retrievable packer configured to rapidly seal an annulus between the work string and the tubular; and a cutting mechanism configured to cut the tubular;

wherein the anchor mechanism of said spear is located between the packer assembly and the cutting mechanism;

wherein in a first configuration the anchor mechanism grips the tubular as the cutting mechanism cuts the tubular and the packer assembly is unset so that cuttings can be circulated up the annulus; and wherein in a second configuration the anchor mechanism grips the tubular, the cutting mechanism is stopped and the packer assembly is set with the annulus sealed so that a circulation test can be performed by pumping fluid from the annulus, through the cut and behind the cut tubular to surface.

2. The assembly according to claim 1 wherein the anchor mechanism is configured to grip a section of a casing located in a wellbore.

3. The assembly according to claim 1 wherein the anchor mechanism is configured to be reversibly set at different axial positions in the casing.

4. The assembly according to claim 1 wherein the assembly has a tool body with a central through bore.

5. The assembly according to claim 4 wherein the mechanical tension-set retrievable packer is configured to seal the downhole tubular providing a fluid passageway only through the central through bore.

6. The assembly according to claim 4 wherein the mechanical-set retrievable packer comprises at least one port providing selective fluid communication between the central through bore and an outer surface of the packer below the packer element.

7. The assembly according to claim 1 wherein the anchor mechanism comprises a cone and at least one slip, the at least one slip being configured to bear against the cone to engage an inner diameter of a section of the downhole tubular.

8. The assembly according to claim 7 wherein the at least one slip is locked against the downhole tubular by application of an upward force on the tool in the range from 2,000 lbs to 15,000 lbs (8896 to 66723 N).

9. The assembly according to claim 1 wherein the anchor mechanism is hydraulically actuated.

10. The assembly according to claim 9 wherein the anchor mechanism is actuated by pumping fluid into the central through bore in the tool above a pre-set flow rate threshold.

11. The assembly according to claim 10 wherein the flow rate threshold is in the range of 50 to 500 gpm (0.0032 to 0.0315 $m^3$/sec).

12. The assembly according to claim 11 wherein the flow rate threshold is 250 gpm (0.0158 $m^3$/sec).

13. The assembly according to claim 1 wherein the mechanical tension-set retrievable packer is operated by application of an upward force in the range from 20,000 lbs to 80,000 lbs (88964 to 355858 N).

14. The assembly according to claim 1 wherein the mechanical tension-set retrievable packer includes a packer element which is compressed by tension applied to a lower end and weight applied to an upper end.

15. The assembly according to claim 1 wherein the cutting mechanism comprises a plurality of knives arranged circumferentially around the tool and a sleeve configured to move the knives between a storage position where the knives are retracted and do not engage the downhole tubular and an operational position where the knives are extended and engage the downhole tubular.

16. The assembly according to claim 1 wherein the cutting mechanism is hydraulically actuated and rotates relative to the anchor mechanism.

17. A method of performing a circulation test in a wellbore, the method comprising:

(a) running a casing cutting and removal assembly comprising:

a spear for casing removal, the spear comprising an anchor mechanism configured to grip a section of a tubular in a wellbore for removal thereof;

a packer assembly being a mechanical tension-set retrievable packer configured to rapidly seal an annulus between the work string and the tubular; and a cutting mechanism configured to cut the tubular;

the anchor mechanism being located between the packer assembly and the cutting mechanism;

wherein in a first configuration the anchor mechanism grips the tubular as the cutting mechanism cuts the tubular and the packer assembly is unset so that cuttings can be circulated up the annulus; and wherein in a second configuration the anchor mechanism grips the tubular, the cutting mechanism is stopped and the packer assembly is set with the annulus sealed so that a circulation test can be performed by pumping fluid from the annulus, through the cut and behind the cut tubular to surface; into the wellbore;

(b) actuating the anchor mechanism to grip a section of a tubular;

(c) actuating the cutting mechanism to cut the tubular while pumping fluid through a bore of the work string to circulate cuttings up an annulus between the work string and the tubular;

(d) deactivating the cutting mechanism;

(e) actuating the packer assembly to seal the annulus; and (f) pumping fluid through the bore of the work string to circulate through the cut and behind the cut tubular to surface as a circulation test in the wellbore.

18. The method according to claim 17 wherein the method comprises the step of determining circulation behind the cut tubular at surface;

wherein on noting circulation behind the cut tubular at surface, the method includes the further steps of unsetting the packer and anchor mechanism, actuating the anchor mechanism to grip the cut tubular section at an upper location on the tubular, and removing the cut tubular section from the wellbore;

and wherein on not obtaining circulation behind the cut tubular at surface, the method includes the further steps of:

(a) unsetting the packer and anchor mechanism;

(b) locating the cutting mechanism at a higher position on the tubular;

(c) actuating the anchor mechanism to grip a section of a tubular;

(d) actuating the cutting mechanism to cut the tubular while pumping fluid through a bore of the work string to circulate cuttings up an annulus between the work string and the tubular;

(e) deactivating the cutting mechanism;

(f) actuating the packer assembly to seal the annulus; and (g) pumping fluid through the bore of the work string to circulate through the cut and behind the cut tubular to surface as a circulation test in the wellbore.

* * * * *